United States Patent [19]

Furukawa et al.

[11] Patent Number: 4,636,452

[45] Date of Patent: Jan. 13, 1987

[54] METHOD FOR PRODUCING LIQUID DEVELOPER FOR ELECTROPHOTOGRAPHY

[75] Inventors: Akira Furukawa; Takao Senga; Shigeyoshi Suzuki, all of Nagaokakyo, Japan

[73] Assignee: Mitsubishi Paper Mills. Ltd., Tokyo, Japan

[21] Appl. No.: 649,411

[22] Filed: Sep. 11, 1984

Related U.S. Application Data

[63] Continuation-in-part of Ser. No. 546,955, Oct. 31, 1983, abandoned.

[30] Foreign Application Priority Data

| | | | |
|---|---|---|---|
| Nov. 4, 1982 | [JP] | Japan | 57-194223 |
| Mar. 29, 1983 | [JP] | Japan | 58-54534 |
| May 18, 1983 | [JP] | Japan | 58-86957 |
| Jun. 10, 1983 | [JP] | Japan | 58-103953 |
| Apr. 24, 1984 | [JP] | Japan | 59-82623 |

[51] Int. Cl.[4] ..... G03G 9/12

[52] U.S. Cl. ..... 430/112; 430/114; 430/137

[58] Field of Search ..... 430/137, 112, 114

[56] References Cited

U.S. PATENT DOCUMENTS

| | | | |
|---|---|---|---|
| 3,849,165 | 11/1974 | Stahly et al. | 430/114 |
| 4,250,241 | 2/1981 | Tsubuko et al. | 430/137 |
| 4,473,630 | 9/1984 | Yokoya et al. | 430/137 |

*Primary Examiner*—John L. Goodrow

*Attorney, Agent, or Firm*—Cushman, Darby & Cushman

[57] ABSTRACT

Disclosed is a method for producing a resin dispersion type electrophotographic liquid developer containing resin particles dispersed in a high insulation hydrocarbon medium which comprises, in the presence of a first polymer dissolved in said medium which is soluble in said medium and has a polar functional group having adsorptivity to a second polymer, polymerizing a monomer having a polar functional group having adsorptivity to said first polymer to produce the second polymer which is low in solubility in said medium and is substantially particle.

12 Claims, No Drawings

METHOD FOR PRODUCING LIQUID DEVELOPER FOR ELECTROPHOTOGRAPHY

CROSS REFERENCE TO THE RELATED APPLICATION

This is a Continuation-in-Part of U.S. Ser. No. 546,955 filed on October 31, 1983 now abandoned.

BACKGROUND OF THE INVENTION

This invention relates to a novel process of producing a liquid developer for use in the development of an electrostatic latent image, and, more particularly to a convenient process for producing toner particles excellent in dispersion stability.

In general, liquid developers comprise a hydrocarbon medium of high insulation resistance and, dispersed therein, colored particles of several μm or below in size provided with a positive or negative electric charge. In stabilizing a dispersion of such fine particles in non-aqueous media, utilization of the coulomb repulsion originated from the charge on the surface of each particle is not a dependable means to resort to, unlike the case of an aqueous emulsion; a generally effective way is to establish a protective adsorption layer of a polymer around each particle to take advantage of the steric repulsive effect between particles enveloped in such a layer.

As an example of a polymer suitable for forming the protective adsorption layer, there may be mentioned a graft- or block-copolymers having in the skeletal structure of its molecule both components soluble and insoluble in the dispersion medium. The ability to stabilize the dispersed particles, however, is comparatively sensitive to the composition, structure, and moledular weight of such a graft- or block-copolymer and it is very difficult in practice to synthesize a copolymer of controlled structure and molecular weight.

There is another process such as is disclosed in, for example, U.S. Pat. No. 4,081,391, which comprises introducing a polymerizable vinyl group into a precursor polymer, and polymerizing a monomer in the presence of the resulting vinyl-containing precursor polymer to produce a graft copolymer. In such a process, depending upon the concentration of the precursor polymer, there occurs crosslinking reaction among polymer molecules, resulting in indispersible particles.

Another necessary condition for the formation of a stable dispersion is associated with the particle size. In order that a liquid developers may remain as a stable emulsion without settling of toner particles during a long-term storage or in use, the particle size is required to be several μm or less, preferably 0.3 to 0.4 μm or less. As for the developing characteristics, a narrow particle size distribution is expected to be favorable for the uniform reproduction of an image. It is, therefore, an important problem for the liquid developer to control the particle size and its distribution.

In the conventional method of forming dispersed particles by the use of graft- or block-copolymers, the requirements for the particle size and its distribution can be met to a certain extent, in principle, by the control of the structure of graft- or block-copolymers, but the practicability is questionable.

SUMMARY OF THE INVENTION

According to this invention, there is provided a method which does not employ the graft- or block-copolymer but utilizes the interaction between a soluble polymer containing a polar functional group and an insoluble polymer containing a polar functional group in a medium to stabilize the dispersion of particles, formed from said insoluble polymer; there is also provided a method for controlling the particle size of said insoluble polymer by controlling the concentrations of the polar funcitonal groups in both polymers.

The present invention offers an advantage of forming particles which exhibit desirable dispersion stability, without empoloying a graft- or block-copolymer, and a simple and convenient procedure for producing dispersed particles. The process of the present invention permits steady production of uniformly dispersed particles with satisfactory reproducibility, because the size of particles is controlled by the number of polar functional groups in the polymer molecule. The present invention, therefore, offers an advantageous procedure also from the practical point of view.

The objects of this invention, therefore, are to obtain a polymer suspension excellent in dispersion stability, without employing graft- or block-copolymers, to provide a method for producing a stable dispersion by polymerizing a monomer in the presence of a soluble polymer to form a polymer adsorbable to the soluble polymer and substantially insoluble in the polymerization medium, and to obtain dispersed polymer particles of desired size by controlling the number of adsorption sites existing in the polymer as described later.

DESCRIPTION OF THE INVENTION

The dispersed polymer particles obtained according to this invention are composed essentially of a polymer soluble in the medium (hereinafter referred to as the first polymer) and a polymer substantially insoluble in the medium (hereinafter referred to as the second polymer). Both the first and the second polymers contain polarfunctional groups. Owing to the interaction between such functional groups, the first polymer is adsorbed to the surface of the second polymer, forming a protective adsorption layer which keeps the particles from agglomeration or coagulation.

The dispersed particles according to this invention are composed of the first and second polymers having functional groups which exert the interaction. Such functional groups are combinations of any one functional group selected from the following Class I and any one functional group selected from the following Class II.

Class I (acidic groups):

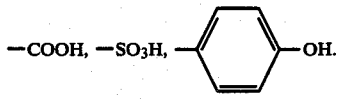

Class II (basic groups): Basic nitrogen containing groups such as $-NH_2$, $-N(C_nH_{2n+1})_2$ (n = 1, 2 or 3),

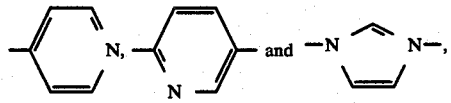

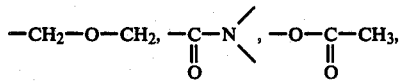

-continued

—OH (alcoholic hydroxyl group), $—NO_2$, —CH.

Monomers having a functional group of Class I are acrylic acid, methacrylic acid, 3-vinyl-propionic acid, mono($C_1$–$C_8$)alkyl maleate, mono($C_1$–$C_8$)alkyl fumarate, maleic acid, itaconic acid, crotonic acid, sulfoethyl acrylate, sulfoethyl methacrylate, sulfopropyl acrylate, sulfopropyl methacrylate, 2-methyl-3-sulfopropyl acrylamide, p-hydroxystyrene, p-hydroxybenzyl acrylate, and p-hydroxybenzyl methacrylate, etc.

Monomers having a functional group of Class II are vinylamine, N,N-dimethylaminoethyl acrylate, N,N-dimethylaminoethyl methacrylate, N,N-diethylaminoethyl acrylate, N,N-diethylaminoethyl methacrylate, N,N-dipropylaminoethyl acrylate, 2-hydroxyethyl acrylate, 2-hydroxypropyl acrylate, 3-hydroxypropyl acrylate, 2-hydroxy-3-chloropropyl acrylate, 1,4-butylene glycol monoacrylate, 2-hydroxyethyl methacrylate, 2-hydroxypropyl methacrylate, 3-hydroxypropyl methacrylate, 2-hydroxy-3-chloropropyl methacrylate, 1,4-butylene glycol monomethacrylate, carbitol acrylate, methoxyethyl acrylate, ethoxyethyl acrylate, butoxyethyl acrylate, methoxypolyethylene glycol acrylate [$CH_2{=}CH{-}COO{-}C_2H_4O)_nCH_3$, n=1–25], tetrahydrofurfuryl acrylate, glycidyl acrylate, methoxyethyl methacrylate, methoxypolyethylene glycol methacrylate [$CH_2{=}C(CH_3){-}COO{-}C_2H_4O)_nCH_3$, n=1–25], polypropylene glycol monomethacrylate $$[CH_2{=}C(CH_3){-}COO{-}(CH_2\overset{\overset{CH_3}{|}}{C}H{-}O)_mH,\ m = 1\text{-}25],$$

tetrahydrofurfuryl methacrylate, methacryloxy propyltrimethoxy silane, glycidyl methacrylate, vinyl acetate, N-vinyl-2-pyrrolidone, acrylamide, methacrylamide, N-tert-butylacrylamide, N-tert-octylacrylamide, N-butoxymethylacrylamide, diacetone acrylamide, N-vinylimidazole, N-vinyl-2-methylimidazole, 4-vinylimidazole, 1-vinylpyrrole, 3,5-dimethylvinylpyrazole, 4-vinylpyridine, 2-methyl-5-vinylpyridine, 9-vinylacridine, 4-vinylquinoline, 2-vinylquinoline, and ($C_1$–$C_4$)alkyl vinyl ether, etc.

The first polymer used in this invention is a polymer soluble in a medium for liquid toner such as, for example, a high insulation resistance hydrocarbon. To impart solubility to the polymer, it is desirable to introduce as a comonomer a monomer selected from the compounds of the following general formula (a), in addition to the monomer having a functional group of Class I or II.

$$CH_2{=}\overset{\overset{X}{|}}{C}{-}Y \qquad \text{(a)}$$

wherein X is H or $CH_3$ and Y is $CO_2C_mH_{2m+1}$ ($6 \leqq m \leqq 22$), $C_nH_{2n+1}$ ($2 \leqq n \leqq 20$), or $OC_pH_{2p+1}$ ($6 \leqq p \leqq 20$).

Specific examples of the compounds of the general formula (a) are lauryl methacrylate, 2-ethylhexyl methacrylate, 2-ethylhexyl acrylate, stearyl methacrylate, vinylstearyl ether, lauryl acrylate, cetyl methacrylate, etc.

The ratio of a monomer of the formula (a) to a monomer selected from Class I or II is preparably more than 2.5/1.0 on molar ratio.

As examples of high insulation resistance hydrocarbons, mention may be made of n-paraffin hydrocarbons, isoparaffin hydrocarbons, cycloaliphatic hydrocarbons, aromatic hydrocarbons, and halogenated aliphatic hydrocarbons. Of these hydrocarbons, desirable ones are isoparaffin hydrocarbons such as, for example, Shellsol 71 (Shell Petroleum Co.), Isopar G, H, K and L (Esso Petroleum Co.).

As the monomer for producing the second polymer which is substantially insoluble in the above carrier liquid and forms dispersed particles, there may be used any of those which are soluble in the carrier liquid and become decreased in solubility with the progress of polymerization and finally precipitate from the medium. In this case, if the monomer used have the functional group of Class (I) or (II), dispersed particles can be obtained by polymerizing the monomer alone. If a monomer having none of such functional groups is used, the desired dispersed particles can be produced by adding as a comonomer a suitable monomer having a functional group selected from Class I or II. Examples of monomers forming the second polymers other than those having a functional group of Class I or II include styrene and derivatives thereof, $C_1$- to $C_5$-alkyl acrylates or methacrylates, methyl vinyl keton, ethyl vinyl ketone, vinyl propionate, vinyl pivalate, etc.

Generally speaking, the ratio of the first polymer to the second one is 10–100% by weight, preferably 15–35% by weight.

It is indeed possible to obtain dispersed polymer particles exhibiting fairly good dispersion stability by separately preparing the first and second polymers, dissolving the resulting polymers in a solvent common to both polymers, and adding the solution dropwise to a high insulation resistance hydrocarbon. Such a method, however, is not desirable, because not only the common solvent retained in relatively large amounts in the dispersion system exerts undesirable influences such as deterioration in the insulation resistance of the dispersion medium but also there occurs, in some cases, a large amount of aggregates upon the dropwise addition of the polymer solution, unless some countermeasure such as exposure to ultrasonic vibration is taken.

As contrasted, according to this invention, when the second polymer is formed by polymerizing in the presence of dissolved first polymer a monomer which is soluble in the medium but becomes insoluble upon polymerization, there is no need to employ a solvent common to both polymers as mentioned above and there are always obtained, as final product, polymer particles in the form of stable dispersion. The first polymer existing in the polymerization system acts only as an adsorbent against the precipitated second polymer and there occurs substantially or entirely no grafting of the monomer onto the first polymer. It is solely the interaction between functional groups existing in the first and second polymers that protects and stabilizes the polymer particles which are formed. This is evidenced by the fact that polymer particles in the form of stable emulsion are not produced when both polymers have no such functional groups as mentioned above.

The control of the size of dispersed particles is possible by the control of the concentrations of functional groups in the first and second polymers which are selected from Class I or II. For instance, an increase in the concentration of adsorption sites in the second polymer promotes the formation of polymer particles, resulting in a decrease in particle size due to the increase in number of particles. When a monomer having a relatively high polarity is used in the formation of the second polymer, the solubility of the resulting polymer is decreased, resulting in a decrease in particle size due to the increase in number of particles formed at the initial stage of polymerization. On the contrary, when a monomer of the general formula (a) is used in producing the second polymer, the rate of formation of the particles is decreased, resulting in an increase in particle size. The control of particle size is possible also by the control of the ratio between the first and the second polymers. When the concentration of the first polymer in the polymerization system is decreased, the number of adsorption sites for the second polymer is decreased, resulting in an increase in the particle size.

According to this invention, the control of the size of dispersed particles has become possible to a considerable extent by taking advantage of the phenomena mentioned above. Such methods of controlling the particle size have overcome the difficulties encountered in the practice of conventional processes for protecting and stabilizing the dispersed particles by block- or graft-copolymerization as described, for example, in K. E. J. Barrett, Editor: "Dispersion Polymerization in Organic Media," John Willey and Sons, London 1974.

In order to be suitable for use as a liquid toner in electrophotography, the dispersed particles in the polymer dispersion obtained as described above should be colored and electrostatically charged. The coloring matters for the dispersed particles may be any of those generally used in liquid toners. Examples of such coloring matters classified under dyes are oil-soluble azo dyes such as Oil Black and Oil Red; basic azo dyes such as Bismarck Brown and Chrysoidine; acid azo dyes such as Wool Black, Acid Black Green, and Blue Black HF; direct dyes such as Direct Deep Black E and Congo Red; anthraquinone dyes such as Sudan Violet and Acid Blue; carbonium dyes such as Auramine, Malachite Green, Crystal Violet, and Victoria Blue; rhodamine dyes such as Rhodamine B; and quinoneimine dyes such as Safranin, Nigrosine, and Methylene Blue. Examples of coloring matters classified under pigments are carbon black, Phthalocyanine Blue, Phthalocyanine Green, Watching Red, and Benzidine Yellow. There may be used also surface-treated pigments such as carbon black dyed with Nigrosine, Graft Carbon, finely powdered silicon oxide dyed with Rhodamine B, and Micro Lith Blue.

The coloring of dispersed polymer particles can be performed by dissolving a dye in a solvent which dissolves the dye, and adding the dye solution dropwise to the stirred polymer dispersion. As for the solvent for dyes, it is desirable to select one miscible with the carrier liquid such as, for example, and isoparaffinic hydrocarbon. A preferred solvent has a relatively high insulation resistance and a high boiling point. For instance, when an oil-soluble dye soluble in an aromatic hydrocarbon is selected, it is used as a solution in a small amount of xylene which is not necessarily be removed afterward from the liquid toner to obtain a product which is sufficiently fit for use in electrophotography. Therefore, it is generally unnecessary to remove the solvent for dye after the coloration of dispersed polymer particles has been completed, if the amount of solvent relative to the dye is kept small by using a dye having a comparatively high solubility in an organic solvent, such as an oil-soluble dye. In the polymer dispersion according to this invention, a functional group having an adsorptive activity, which is present in the dispersed particles, can be utilized as adsorption site for a dye or pigment. By introducing into a polymer a functional group of comparatively high polarity (high dipole moment), it becomes possible to increase the dyeing affinity (adsorption power) toward a dye or pigment and reduce the desorption of the dye or pigment from the colored particles. There is a case in which when a concentrated dye solution is added to a polymer dispersion, the dye tends to precipitate out of the dispersion medium. In such a case, if a functional group having an affinity for the dye is present in the polymer particle, the precipitated dye molecule is adsorbed as such to the polymer particle to perform the coloring successfully. As a consequence, the solubility of the dye becomes not so important and the amount of solvent for the dye can be extremely reduced.

The liquid developer of the present invention can be prepared optionally so as to contain either positively charged or negatively charged toner particles by proper selection of a charge controlling agent and dye or pigment. To prepare a positively charged liquid toner, it is generally desirable to select the first polymer functional group from Class I and the second polymer functional group from Class II. On the contary, in preparing a negatively charged liquid toner, it is desirable to select the first polymer functional group from Class II and the second polymer functional group from Class I. When a basic group (Class II) is present on the surface of particles comprising the second polymer, the cationic portion generated by the dissociation of a charge controlling agent is adsorbed to the polymer particles, resulting in positively charged particles, whereas when an acidic group (Class II) is present on the surface of particles comprising the second polymer, the anionic portion is adsorbed, resulting in negatively charged particles.

As examples of charge control agents for use in the present liquid toner, there may be mentioned copper oleate, cobalt naphthenate, zinc naphthenate, manganese naphthenate, cobalt octylate, lecithin, sodium dioctylsulfosuccinate, and aluminum salt of stebelyte rosin, etc.

The liquid toner obtained by the process of this invention as described above should be not only excellent in dispersion stability of the toner particles but also able to meet other requirements such as an excellent charge stability, a high adsorption affinity for dyes or pigments, a desirable fixability, little change in developing characteristics over a prolonged time period of storage or use, and easy maintainance of the developing equipment. For instance, in preparing a liquid toner for use in developing a commercial zinc oxide master, an effective polymer combination to meet the above requirements is such that the first polymer is a carboxyl-containing soluble polymer and the second polymer is a polymer insoluble in a high insulation resistance hydrocarbon medium which is derived from vinyl acetate and an polymerizable heterocyclic compound having at least one nitrogen atom in the ring.

Polyvinyl acetate is a suitable resin for use in electrophotographic liquid toner, because it has a relatively low glass transition temperature, is easily fixable, and has a high adsorption affinity for dyes and pigments. By using vinyl acetate as one of the constituents of the second polymer, the problems of fixability and dyability of the toner particles can be settled. By introducing into the second polymer an polymerizable heterocyclic compound having at least one nitrogen atom in the nucleus such as, for example, N-vinyl-2-pyrrolidone, 2-vinylpyrazine, or N-vinylimidazole as a comonomer, the adsorption of a charge controlling agent is facilitated and, in addition, the adsorption sites are provided for the first polymer having carboxyl groups, whereby the requirements for the charge stability and the dispersion stability are both fulfilled. Even if the vinyl acetate monomer and the heterocyclic monomer are copolymerizable in any proportion, it may be desirable that the proportion of vinyl acetate units in the insoluble copolymer be 50% or more, preferably 70% or more, by weight and the proportion of nitrogen-containing heterocyclic compound units be 50% or less, preferably 1 to 30%, by weight. The copolymer insoluble in the dispersion medium may contain, if necessary, other structural units of polymerizable monomers such as (meth)acrylic esters, acylamide, and dialkylaminoethyl (meth)acrylate. In such cases, the proportions of vinyl acetate and a heterocyclic compound in the polymer are preferably in the ranges given above.

As a result of the inventors' further intensive researches for preventing stains of the resultant printing plates caused by sticking of toner particles to squeeze rollers immediately after development at actual use of the electrophotographic liquid developers, it has been further found that said object can be attained by providing an electrophotographic liquid developer which comprises a high insulation resistance hydrocarbon medium and (a) particles of a second polymer substantially insoluble in said medium which contains at least vinyl acetate and a polymerizable compound having at least one ether bond or hydroxyl group in the molecule, (b) a first polymer soluble in said medium which contains a polymerizable carboxyl-containing compound, (c) a coloring dye and (d) a charge controlling agent which are contained in said medium. In this case, too, it is preferred for improving charge stability to add the heterocyclic compound, e.g., N-vinyl-2-pyrrolidone as a commoner for forming particles (a).

As a commonomer for forming the copolymer particles (a), generally said polymerizable compound having at least one ether bond or hydroxyl group is copolymerized in an amount of 1 to 50% by weight, preferably 5 to 20% by weight to obtain toner particles which cause no sticking to rolls and are excellent in dispersion stability.

If it is intended to use the present liquid toner in the development of the lithographic printing master described in Japanese Patent Application Nos. 175,048/81 and 175,049/81, a liquid toner of the composition similar to that disclosed, for example, in Japanese Patent Application No. 4,157/82 can be obtained by adding styrene or its derivatives to the monomer composition for forming the second polymer. When the development of the master is performed by use of the above liquid toner and then fixed, there is formed a toner image resistant to an aqueous alkaline etching solution.

EXAMPLE 1

Into a 1-liter flask provided with a stirrer, a thermometer, and a nitrogen inlet, were charged 500 g of IP Solvent (an isoparaffin-base hydrocarbon solvent of Idemitsu Petroleum Co.), 190 g of stearyl methacrylate, and 10 g of methacrylic acid. The mixture was stirred for 30 minutes at 75° C. under a nitrogen stream. After addition of 1 g of azobisisobutyronitrile (AIBN) as polymerization initiator, the mixture was heated in a water bath at 75° C. for 3 hours to allow the polymerization to proceed, whereby a solution of the first polymer was obtained. A 100 g portion of the solution was placed in a 1-liter flask provided with a stirrer, a thermometer, a dropping funnel, and a nitrogen inlet. After addition of 300 g of IP Solvent, the flask was placed in a water bath at 70° C. To prepare the second polymer, a mixture of 90 g of methyl methacrylate, 10 g of N,N-dimethylaminoethyl methacrylate, and 1 g of AIBN was added into the flask through the dropping funnel dropwise over a time period of 3 hours. The mixture was further heated for 3 hours under a nitrogen atmosphere and then cooled down to room temperature. The reaction product was a white emulsion of 0.12μ in average particle size and excellent in dispersion stability. To the emultion, was added dropwise with stirring a solution of 5 g of Oil Yellow GG-S (Orient Chemical Co.) in 20 g of xylene, followed by 1 g of aluminum stearate as charge controlling agent. The emulsion was then diluted 50-fold with IP Solvent to yield a liquid toner which carried a positive charge and exhibited good dispersion stability.

EXAMPLE 2

Into 1.5-liter flask provided with a stirrer, a thermometer, and a nitrogen inlet, were charged 500 g of IP Solvent, 100 g of lauryl methacrylate and 5 g of methacrylic acid followed by 1 g of benzoyl peroxide (BPO). The mixture was allowed to polymerize in a water bath at 85° C. for 5 hours to yield a solution of the first polymer. To prepare the second polymer, a mixture of 100 g of methyl acrylate, 5 g of diethylaminoethyl methacrylate, 100 g of IP Solvent, and 1 g of AIBIN was added from the dropping funnel into the flask dropwise over a time period of 2 hours, while heating on a water bath at 75° C. The mixture was further heated at 85° C. for 3 hours. In a manner similar to that in Example 1, to the resulting emulsion, were added a solution of 5 g of Oil Yellow in 20 g of xylene and 1 g of aluminum stearate. The emulsion was then diluted 50-fold with IP Solvent to yield a liquid toner of excellent dispersion stability in the form of yellow emulsion, 0.2μ in average particle size.

EXAMPLE 3

The first polymer, a lauryl methacrylatemethacrylic acid copolymer, was prepared in the same manner as in Example 2. The formation of the second polymer was carried out in the presence of the above copolymer under varied conditions as shown in Table 1, in which are also shown the test results.

TABLE 1

Change in average size of polymer particles formed under varied polymerization conditions
(Solvent: 500 g IP Solvent; temperature: 75° C.; initiator: 1.0 g AIBN)

| Run No. | Lauryl methacrylatemethacrylic acid copolymer (g) | Methyl methacrylate (g) | Diethylaminoethyl methacrylate (g) | Average size of polymer particle (μ) |
|---|---|---|---|---|
| 1 | None | 50 | 10 | Agglomeration |
| 2 | 10 | 50 | None | ≧1 |
| 3 | 10 | 60 | 10 | 0.21 |
| 4 | 10 | 50 | 20 | 0.11 |
| 5 | 20 | 60 | 10 | 0.15 |
| 6 | 20 | 100 | 40 | 0.30 |
| 7 | 20 | 100 | 20 | 0.51 |
| 8 | 20 | 50 | 50 | 0.05 |

TABLE 1-continued

Change in average size of polymer particles formed under varied polymerization conditions (Solvent: 500 g IP Solvent; temperature: 75° C.; initiator: 1.0 g AIBN)

| Run No. | Lauryl methacrylatemethacrylic acid copolymer (g) | Methyl methacrylate (g) | Diethylaminoethyl methacrylate (g) | Average size of polymer particle (μ) |
|---|---|---|---|---|
| 9 | 40 | 100 | 20 | 0.31 |

EXAMPLE 4

To 500 g of a 10-% solution of lauryl methacrylate-methacrylic acid copolymer prepared as shown in Example 2, were added 200 g of IP Sovlent, a monomer mixture comprising 100 g of styrene, 10 g of 4-vinylpyridine, and 50 g of methyl methacrylate for forming the second polymer, and 1.5 g of AIBN as initiator. The resulting mixture was stirred at 75° C. for 5 hours under a nitrogen atmosphere. The reaction product was a stable emulsion of 0.20μ in average particle size.

EXAMPLE 5

A stable emulsion was formed by repeating the procedure of Example 4, except that 1-vinyl-2-methylimidazole was used in place of the 4-vinylpyridine.

EXAMPLE 6

To 500 g of a 10-% solution of lauryl methacrylate-methacrylic acid copolymer prepared as shown in Example 2, were added 100 g of vinyl acetate and 1 g of AIBN. The mixture was heated at 75° C. for 3 hours to obtain a white emulsion of 0.21μ in average particle size. To 100 g of the emulsion, was added a solution of 2 g of Victoria Blue in 50 g of methanol. The mixture was heated with stirring. The reaction product was a stable emulsion, blue in color.

EXAMPLE 7

In a manner similar to that in Example 6, 100 g of vinyl acetate, 20 g of dimethylaminoethyl acrylate, and 1 g of AIBN were added to 500 g of a 10-% solution of lauryl methacrylate-methacrylic acid copolymer, and the mixture was stirred at 75° C. for 4 hours. The reaction product was a stable white emulsion of 0.09μ in average particle size.

EXAMPLE 8

In a manner similar to that in Example 6, 100 g of vinyl acetate, 20 g of n-butyl acrylate, 10 g of dimethylaminoethyl acrylate, 200 g of IP Solvent, and 1.5 g of AIBN were added to 500 g of a 10-% solution of lauryl methacrylate-methacrylic acid copolymer. The mixture was heated at 75° C. for 6 hours. The reaction product was a white emulsion of 0.25μ in average particle size. To the emulsion, was added dropwise with stirring a solution of 5 g of Oil Yellow GG-S (Orient Chemical Co.) in 20 g of xylene. After addition of 1 g of ferric stearate as charge controlling agent, the mixture was diluted 50-fold with IP Solvent to obtain an electrophotographic liquid developer which showed good dispersion stability and was excellent in fixability.

EXAMPLE 9

To 500 g of a 10-% solution of lauryl methacrylate-methacrylic acid copolymer prepared as shown in Example 2, were added 200 g of IP Solvent, 50 g of methyl methacrylate, 10 g of acrylonitrile, and 1 g of AIBN. The mixture was stirred at 80° C. under a nitrogen stream. The reaction product was an emulsion of 0.10μ in average particle size.

EXAMPLE 10

Into a 1-liter flask provided with a stirrer, a thermometer, and a nitrogen inlet, were charged 100 g of stearyl methacrylate 10 g of methoxypolyethylene glycol methacrylate $$[CH_2{=}\overset{\overset{\displaystyle CH_3}{|}}{C}{-}COO{\leftarrow}CH_2CH_2O{\rightarrow}_n CH_3,\ n = 9],$$

6 g of monomethyl maleate, and 1.8 g of AIBN. After addition of 500 g of IP Solvent, the mixture was stirred at 75° C. for 5 hours. To a 100 g portion of the reaction mixture, were added 50 g of methyl methacrylate, 35 g of styrene, 10 g of hydroxyethyl methacrylate, and 1.0 g of AIBN. The mixture was stirred at 75° C. for 5 hours to yield a stable emulsion of 0.15μ in average particle size. To the emulsion, was added dropwise with stirring a solution of 8 g of Oil Black HBB (Orient Chemical Co.) in 60 g of xylene. After addition of 1.5 g of aluminum stearate as charge controlling agent, the emulsion was diluted with IP Solvent to a solids content of 0.9% to obtain a liquid toner. A lithographic printing master described, for example, in Japanese Patent Application Nos. 175,048/81, 175,049/81, and 4,158/82 was applied with the above liquid toner. After development and fixing, the master was subjected to the etching treatment with an aqueous alkaline solution. It was found that the present liquid developer can be used as a liquid developer having a desirable etch resistance.

EXAMPLE 11

To 500 g of a 10-% solution of lauryl methacrylate-methacrylic acid copolymer prepared as shown in Example 2, were added 200 g of IP Solvent, 50 g of methyl methacrylate, 50 g of styrene, 10 g of N-viylpyrrolidone, and 1 g of AIBN. The mixture was stirred at 75° C. to yield a stable emulsion of 0.12μ in average particle size.

EXAMPLE 12

To 500 g of IP Solvent, were added 100 g of stearyl methacrylate and 1 g of p-vinylbenzenesulfonic acid. After addition of 1 g of AIBN, the mixture was stirred at 75° C. for 3 hours. To a 100 g portion of the reaction mixture, were added 50 g of methyl methacrylate, 5 g of hydroxypropyl acrylate, 300 g of IP Solvent, and 1.0 g of benzoyl peroxide (BPO). The mixture was allowed to polymerize at 85° C. for 5 hours to obtain an emulsion of 0.09μ in average particle size.

EXAMPLE 13

A mixture of 50 g of 2-ethylhexyl acrylate, 5 g of p-nitrostyrene, 0.5 g of AIBN, and 100 g of IP Solvent was stirred at 75° C. for 3 hours. To the reaction mixture, were added 30 g of styrene, 60 g of methyl methacrylate, 8 g of hydroxyethyl methacrylate, and 1.5 g of BPO. The mixture was stirred at 90° C. for 4 hours to yield an emulsion of 0.30μ in average particle size.

EXAMPLE 14

Into a 1-liter flask provided with a stirrer, a thermometer, and a nitrogen inlet, were charged 500 g of IP Solvent (Idemitsu Petroleum Co.), an isoparaffin-base hydrocarbon solvent, 170 g of stearyl methacrylate, and 30 g of dimethylaminoethyl methacrylate. The mixture was stirred at 75° C. for 30 minutes under a nitrogen stream. After addition of 1 g of azobisisobutyronitrile (AIBN), a polymerization initiator, the mixture was allowed to polymerize in a water bath at 75° C. for 3 hours to obtain a solution of soluble polymer. A 100 g portion of the solution was placed in a 1-liter flask provided with a stirrer, a thermometer, a dropping funnel, and a nitrogen inlet, and diluted with 300 g of IP Solvent. To the diluted solution, while being heated in a water bath at 70° C., were added through the dropping funnel dropwise over a period of 3 hours a mixture of 90 g of methyl methacrylate, 10 g of acrylic acid (these are monomer and comonomer for forming an insoluble polymer), and 1 g of AIBN. The polymerization mixture was further heated for 3 hours under a nitrogen stream, and thereafter cooled down to room temperature. The reaction mixture was a white emulsion containing a composite resin as dispersed phase, 0.2μ average particle size, which was excellent in dispersion stability. To the emulsion, while being stirred, was added dropwise a solution of 5 g of Oil Yellow GG-S (Orient Chemical Co.) in 20 g of xylene. After addition of 1 g of sodium dioctylsulfosuccinate as charge controlling agent, the emulsion was diluted 50-fold with IP Solvent to prepare a liquid toner which was a negatively charged liquid developer exhibiting desirable dispersion stability and charge stability even when used for a prolonged time period.

EXAMPLE 15

The procedure of Example 14 was repeated, except that 40 g of styrene, 30 g of methyl methacrylate, 20 g of n-butyl acrylate, and 10 g of methacrylic acid were used in preparing the second polymer. Results similar to those in Example 14 were obtained.

EXAMPLE 16

The procedure of Example 14 was repeated, except that 90 g of vinyl acetate, 5 g of methyl acrylate, and 5 g of acrylic acid were used in forming the second polymer. Results similar to those in Example 14 were obtained.

EXAMPLE 17

A solution of soluble polymer was obtained in the same manner as in Example 2, except that 100 g of lauryl methacrylate and 10 g of N-vinylpyrrolidone were used in preparing the first polymer. The results obtained were similar to those obtained in Example 16. For reference, a developer was prepared without using the N-vinylpyrrolidone. The developer contained a large number of coarse particles, 1μ or more in size, and deposited a large amount of sediment with the lapse of time.

EXAMPLE 18

The procedure of Example 15 was repeated, except that 80 g of lauryl methacrylate, 10 g of N-vinylpyrrolidone, and 10 g of diethylaminoethyl methacrylate were used in forming the first polymer.

EXAMPLE 19

The procedure of Example 14 was repeated, except that 60 g of ethyl methacrylate, 30 g of glycidyl methacrylate, and 10 g of itaconic acid were used in forming the second polymer.

EXAMPLE 20

The procedure of Example 14 was repeated except that the second polymer was formed as in Example 19 and the first polymer was formed from 100 g of lauryl methacrylate and 15 g of 4-vinylpyridine.

EXAMPLE 21

The procedure of Example 15 was repeated, except that the first polymer was prepared from 10 g of methyl vinyl ether, 70 g of lauryl acrylate, and 20 g of dimethylaminoethyl methacrylate.

EXAMPLE 22

Into a 1-liter flask provided with a stirrer, a thermometer, and a nitrogen inlet, were charged 100 g of stearyl methacrylate, 10 g of methoxypolyethylene glycol methacrylate $$[CH_2{=}\overset{\overset{\displaystyle CH_3}{|}}{C}{-}COO{\leftarrow}CH_2CH_2O{\rightarrow}_n CH_3,\ n = 9],$$

10 g of dimethylaminoethyl methacrylate, 3 g of acrylamide, and 1.8 g of AIBN. After addition of 500 g of IP Solvent, the mixture was stirred at 75° C. for 5 hours. To 100 g of the resulting solution, were added 50 g of methyl methacrylate, 35 g of styrene, 10 g of hydroxyethyl methacrylate, 10 g of acrylic acid, and 1.0 g of AIBN. The mixture was stirred at 75° C. for 5 hours to yield a stable emulsion of 0.3μ in average particle size. To the stirred emulsion, was added dropwise a solution of 8 g of Oil Black HBB (Orient Chemical Co.) in 60 g of xylene. After addition of 1.5 g of lecithin as charge controlling agent, the emulsion was diluted with IP Solvent to a solids content of 0.9% to obtain a toner. This liquid developer was negatively charged and showed desirable dispersion stability.

EXAMPLE 23

Into a 1-liter flask provided with a stirrer, a thermometer, and a nitrogen inlet, were charged 500 g of IP Solvent (Idemitsu Petroleum Co.), an isoparaffin-base hydrocarbon solvent, 100 g of lauryl methacrylate, 5 g of methacrylic acid, and 1 g of benzoyl peroxide (BPO) as polymerization initiator. The mixture was allowed to polymerize by heating in a water bath at 85° C. for 5 hours, whereby a polymer solution was obtained. A 100 g portion of the polymer solution was placed in a 1-liter flask provided with a stirrer, a thermometer, a dropping funnel, and a nitrogen inlet, and diluted with 300 of IP Solvent. To the diluted solution maintained at 70° C. in a water bath, was added through the dropping funnel dropwise over a period of 3 hours a mixture of 100 g of vinyl acetate, 10 g of N-vinylpyrrolidone (these are monomer and comonomer for forming the insoluble copolymer), and 1 g of azobisisobutyronitrile (AIBN) as polymerization initiator. The mixture was further heated for 3 hours under a nitrogen atmosphere, and then cooled down to room temperature to obtain a white emulsion excellent in dispersion stability. To the stirred emulsion, was added dropwise a solution of 5 g of Oil Black HBB (Orient Chemical Co.) in 20 g of xylene. After addition of 1 g of aluminum stearate as charge controlling agent, the emulsion was diluted 50-fold with IP Solvent to obtain a liquid toner which was positively charged and showed good dispersion stability. This toner was a liquid developer suitable for use in treating an electrophotographic offset master coated with zinc oxide. It exhibited sufficient fixability, high image density, and no scumming even when used in long-run development. Among nitrogen-containing heterocyclic compounds, N-vinylpyrrolidone was a compound which gave especially desirable results.

REFERENCE EXAMPLE 1

A toner was prepared in the same manner as in Example 23, except that N-vinylpyrrolidone was not used. This toner was inferior in dispersion stability, charge stability, and image density to the toner obtained in Example 23, and showed a tendency to adhere to the rollers of a developing equipment.

EXAMPLE 24

To 500 g of a 10-% solution of lauryl methacrylate-methacrylic acid copolymer prepared as shown in Example 23, were added 200 g of IP Solvent, 100 g of vinyl acetate, 10 g of acrylonitrile, 10 g of 4-vinylpyridine, and 1.5 g of AIBN. The mixture was stirred at 75° C. for 5 hours under a nitrogen atmosphere. Thereafter the mixture was treated in the same manner as in Example 23. The results obtained were similar to those in Example 23.

EXAMPLE 25

The procedure of Example 24 was repeated, except that 1-vinyl-2-methylimidazole was used in place of 4-vinylpyridine. A stable emulsion similar to that in Example 24 was obtained.

EXAMPLE 26

The procedure of Example 23 was followed, except that 2-ethylhexyl methacrylate was used in place of lauryl methacrylate. The results obtained were similar to those in Example 23.

EXAMPLES 27 to 30

In a manner similar to that in Example 24, 100 g of vinyl acetate, 10 g of n-butyl acrylate, 20 g of a nitrogen-containing heterocyclic compound shown in the following table, 200 g of IP Solvent, and 1.5 g of AIBN were added to 500 g of a 10-% solution of lauryl methacrylate-methacrylic acid copolymer, and the resulting mixture was heated at 75° C. for 6 hours. A liquid developer according to this invention was obtained by adding 2 g of Victoria Blue dissolved in methanol as a coloring dye and 1 g of aluminum salt of stebelyte rosin as a charge controlling agent to the emulsion obtained above. The results obtained were similar to those of Example 24.

| Example No. | Heterocyclic compound |
|---|---|
| 27 | 1-Vinylpyrrole |
| 28 | N—vinylpyrrolidone |
| 29 | N—vinylimidazole |
| 30 | 2-Vinylquinoline |

EXAMPLES 31 to 33

The procedure of Example 23 was repeated, except that lauryl methacrylate-acrylic acid (92:8 by weight) copolymer, stearyl acrylate-acrylic acid (90:10 by weight) copolymer, or lauryl methacrylatemaleic acid (94:6 by weight) copolymer was used in place of lauryl methacrylate-methacrylic acid copolymer. The results obtained were similar to those of Example 23.

EXAMPLE 34

The procedure of Example 23 was repeated, except that the second polymer was vinyl acetate-N-vinylpyrrolidone-n-butyl acrylate-dimethylaminoethyl acrylate (60:10:20:10 by weight) interpolymer. The results similar to those of Example 23 were obtained.

EXAMPLE 35

Into a 1-liter flask provided with a stirrer, a thermometer, and a nitrogen inlet, were charged 500 g of IP Solvent (Idemitsu Petroleum Co.), an isoparaffin-base hydrocarbon solvent, 100 g of lauryl methacrylate and 5 g of methacrylic acid followed by 1 g of benzoyl peroxide (BPO) as polymerization initiator. The mixture was allowed to polymerize in a water bath at 85° C. for 5 hours, whereby a polymer solution was obtained. A 100 g portion of the polymer solution was placed in a 1-liter flask provided with a stirrer, a thermometer, a dropping funnel, and a nitrogen inlet, and diluted with 300 g of IP Solvent. To the diluted solution maintained at 70° C. in a water bath, was added through the dropping funnel dropwise over a period of 3 hours a mixture of 10 g of methyl methacrylate, 75 g of n-butyl methacrylate, 10 g of dimethylaminoethyl methacrylate, 3 g of N-vinylpyrrolidone (these four monomers were used to produce an insoluble interpolymer), and 1 g of azobisisobutyronitrile (AIBN) as polymerization initiator. The mixture was further heated for 3 hours under a nitrogen atmosphere, and then cooled down to room temperature to obtain a white emulsion containing a composite resin as dispersed phase and excellent in dispersion stability. To the stirred emulsion, was added dropwise a solution of 5 g of Oil Yellow GG-S (Orient Chemical Co.) in 20 g of xylene. After addition of 1 g of aluminum stearate as charge controlling agent, the emulsoin was diluted 50-fold with IP Solvent to obtain a liquid toner which was positively charged and showed good dispersion stability. This toner was suitable as a liquid developer for treating an electrophotographic offset master coated with zinc oxide. It exhibited sufficient fixability, high image density, and no scumming even when used in long-run development.

REFERENCE EXAMPLE 2

A toner was prepared in the same manner as in Example 35, except that N-vinylpyrrolidone was not used. As compared with the toner prepared in Example 35, the toner obtained above was inferior in both charge stability and image density.

EXAMPLE 36

To 500 g of a 10-% solution of lauryl methacrylate-methacrylic acid copolymer prepared as shown in Example 35, were added 200 g of IP Solvent, 40 g of styrene, 30 g of methyl methacrylate, 25 g of n-butyl acrylate, 10 g of dimethylaminoethyl methacrylate, 5 g of N-vinylpyrrolidone, and 1.5 g of AIBN. The mixture was stirred at 75° C. for 5 hours under a nitrogen atmosphere. Thereafter the mixture was treated in the same manner as in Example 35. The results obtained were similar to those of Example 35. The toner obtained above showed a high etch resistance against an alkaline solution which is used in preparing a lithographic printing plate by the etching treatment of photosensitive layer containing an organic photoconductive material.

EXAMPLE 37

The procedure of Example 36 was repeated, except that N-vinylpiperidone was used in place of the N-vinylpyrrolidone. The results obtained were similar to those of Example 36.

EXAMPLE 38

The procedure of Example 35 was repeated, except that N-vinylpyridine was used in place of the dimethylaminoethyl methacrylate. The results obtained were similar to those of Example 35.

EXAMPLE 39

The procedure of Example 35 was repeated, except that 2-ethylhexyl methacrylate was used in place of the lauryl methacrylate. The results obtained were similar to those of Example 35.

EXAMPLE 40

The procedure of Example 36 was repeated, except that 2 g of Victoria Blue (methanol solution) was used in place of the Oil Yellow GG-S and 1 g of stebelyte rosin aluminum salt was used in place of the aluminum stearate. The results obtained were similar to those of Example 36.

EXAMPLE 41 to 45

The procedure of Example 36 was repeated, except that the following compounds were used for the basic nitrogen-containing compound. The results obtained were similar to those of Example 36.

Dimethylaminoethyl acrylate
Diethylaminoethyl methacrylate
N-vinylpyrrole
N-vinylimidazole
N-vinylpyridine

EXAMPLE 46

Into a four neck flask provided with a stirrer, a thermometer and a nitrogen inlet pipe, were charged 95 g of n-dodecyl methacrylate, 5 g of methacrylic acid and 100 g of IP Solvent (Idemitsu Petroleum Co.). The mixture was heated to 75° C. and, after addition of 0.5 g of AIBN as a polymerization initiator, was stirred for 2 hours. Thereafter, 300 g of IP Solvent was added to obtain a polymer solution of 20% in solid concentration.

To a 100 g portion of said polymer solution were added 70 g of vinyl acetate, 20 g of 2-methoxyethyl acrylate, 10 g of N-vinyl-2-pyrrolidone and 200 g of IP Solvent. The mixture was heated to 75° C. under a nitrogen atmosphere and 2 g of AIBN was added thereto to initiate the polymerization. The product was a white emulsion of 0.2 μm in particle size excellent in dispersion stability.

Example 47

In the same manner as Example 46, a 20% solution of n-dodecyl methacrylate-methacrylic acid copolymer (95:5 by weight) was obtained. To a 120 g portion of this solution were added 80 g of vinyl acetate, 10 g of N,N-dimethyl aminoethyl acrylate, 10 g of ethylvinyl ether and 200 g of IP Solvent. The mixture was heated to 75° C. and 2 g of AIBN was added thereto to initiate the polymerization. The product was a stable white emulsion of 0.2 μm in particle size.

Example 48

Into a 10 l flask provided with a stirrer, a thermometer and a nitrogen inlet pipe were charged 90 g of stearyl methacrylate and 10 g of acrylic acid followed by addition of 1.5 g of AIBN at 90° C. to carry out the polymerization. After lapse of about 2 hours, 1 kg of IP Solvent was added thereto and a mixture of 10 g of AIBN, 3.5 kg of vinyl acetate, 0.5 kg of N-vinylpyrrolidone and 1 kg of 2-hydroxyethyl acrylate was gradually added dropwise through a dropping funnel and polymerization was carried out at 75° C. The product was a stable white emulsion of 0.1 to 0.2 μm in particle size.

EXAMPLE 49

To 100 g of the emulsion obtained in Example 46 was added dropwise a mixture of 3 g of Oil Black HBB (produced by Orient Chemical Co.), 0.3 g of aluminum salt of stebelyte rosin and 30 g of xylene. Then, this was diluted with and dispersed in 10 l of IP Solvent to obtain a liquid developer. This developer was put in a plate-making equipment for electrophotographic masters coated with zinc oxide and a running test was effected for one month. Throughout the period of this test there were obtained images with no scumming. Moreover, the squeeze rollers at the developing part were kept at clean state.

EXAMPLE 50

To 100 g of the emulsion obtained in Example 47 was added dropwise a mixture of 3 g of Oil Black HBB (produced by Orient Chemical Co.), 0.3 g of aluminum salt of stebelyte rosin and 30 g of xylene. Then, this was diluted with and dispersed in 10 l of IP Solvent to obtain a liquid developer. This developer was put in a plate-making equipment for electrophotographic masters coated with zinc oxide and a running test was effected for one month. Throughout the period of this test there were obtained images with no scumming. Moreover, the squeeze rollers at the developing part were kept at clean state.

EXAMPLE 51

To 100 g of the emulsion obtained in Example 48 was added dropwise a mixture of 3 g of Oil Black HBB (produced by Orient Chemical Co.), 0.3 g of aluminum salt of stebelyte rosin and 30 g of xylene. Then, this was diluted with and dispersed in 10 l of IP Solvent to obtain a liquid developer. This developer was put in a plate-making equipment for electrophotographic masters coated with zinc oxide and a running test was effected for one month. Throughout the period of this test there were obtained images with no scumming. Moreover, the squeeze rollers at the developing part were kept at clean state.

What is claimed is:

1. A method for producing a resin dispersion type electrophotographic liquid developer containing resin particles dispersed in a high insulation resistance hydrocarbon medium which comprises polymerizing, in the presence of a first polymer dissolved in said medium which is soluble in said medium and has a polar functional group having adsorptivity to a second polymer, also dissolved in said medium a monomer having a polar functional group having adsorptivity to said first polymer to produce the second polymer which is low in solubility in said medium and is substantially particle.

2. A method for producing a liquid developer according to claim 1 wherein the polar functional groups having adsorptivity are selected from the combination of groups of the following Class (I) and Class (II):

Class (I):

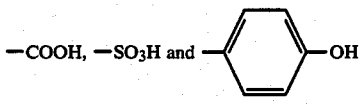

Class (II): basic nitrogen-containing groups,

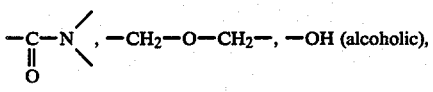

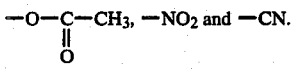

3. A method for producing a liquid developer according to claim 2 wherein the functional group of the first polymer is selected from Class (I) and that of the second polymer is selected from Class (II).

4. A method for producing a liquid developer according to claim 2 wherein the functional group of the first polymer is selected from Class (II) and that of the second polymer is selected from Class (I).

5. An electrophotographic liquid developer prepared according to claim 1 which comprises a high insulation resistance hydrocarbon medium and (a) particles of a second polymer substantially insoluble in said medium which contains at least vinyl acetate and a polymerizable heterocyclic compound having at least one nitrogen atom in the ring, (b) a first polymer soluble in said medium which contains a polymerizable carboxyl-containing compound, (c) a coloring dye and (d) a charge controlling agent which are contained in said medium.

6. An electrophotographic liquid developer prepared according to claim 1 which comprises a high insulation resistance hydrocarbon medium and (a) particles of a second polymer substantially insoluble in said medium which contains at least vinyl acetate and a polymerizable compound having at least one ether bond or hydroxyl group in the molecule, (b) a first polymer soluble in said medium which contains a polymerizable carboxyl-containing compound, (c) a coloring dye and (d) a charge controlling agent which are contained in said medium.

7. An electrophotographic liquid developer prepared according to claim 1 which comprises a high insulation resistance hydrocarbon medium and (a) particles of a second polymer substantially insoluble in said medium which contains at least vinyl acetate and a polymerizable heterocyclic compound having at least one nitrogen atom in the ring and a polymerizable compound having at least one ether bond or hydroxyl group in the molecule, (b) a first polymer soluble in said medium which contains a polymerizable carboxyl-containing compound, (c) a coloring dye and (d) a charge controlling agent which are contained in said medium.

8. An electrophotographic liquid developer according to claim 5 wherein the polymerizable heterocyclic compound having at least one nitrogen atom in the ring is an N-vinyl-heterocyclic ketone compound.

9. An electrophotographic liquid developer according to claim 7 wherein the polymerizable heterocyclic compound having at least one nitrogen atom in the ring is an N-vinyl-heterocyclic ketone compound.

10. An electrophotographic liquid developer prepared according to claim 1 which comprises a high insulation resistance hydrocarbon medium and (A) particles of a second polymer substantially insoluble in said medium which contains at least the following compounds (a), (b) and (c), (B) a first polymer soluble in said medium which contains a polymerizable carboxyl-containing compound, (C) a coloring dye and (D) a charge controlling agent which are contained in said medium:

(a) a polymerizable compound having a basic nitrogen, (b) an N-vinyl-heterocyclic ketone compound, (c) a polymerizable compound other than said (a) and (b).

11. A method according to claim 1 wherein the first polymer further contains as a comonomer a monomer selected from the compounds having the following general formula:

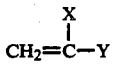

wherein X is H or $CH_3$ and Y is $CO_2C_mH_{2m+1}$ ($6 \leqq m \leqq 22$), $C_nH_{2n+1}$ ($2 \leqq n \leqq 20$), or $OC_pH_{2p+1}$ ($6 \leqq p \leqq 20$).

12. An electrophotographic liquid developer according to claim 5, 6, 7 or 10 wherein the first polymer further contains as a comonomer a monomer selected from the compounds having the following general formula:

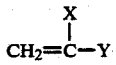

wherein X is H or $CH_3$ and Y is $CO_2C_mH_{2m+1}$ ($6 \leqq m \leqq 22$), $C_nH_{2n+1}$ ($2 \leqq n \leqq 20$), or $OC_pH_{2p+1}$ ($6 \leqq p \leqq 20$).

* * * * *